US005930556A

United States Patent [19]

Imamiya

[11] Patent Number: 5,930,556

[45] Date of Patent: Jul. 27, 1999

[54] IMAGE FORMING APPARATUS

[75] Inventor: Koji Imamiya, Kanagawa-ken, Japan

[73] Assignee: Kabushiki Kaisha Toshiba, Kanagawa-ken, Japan

[21] Appl. No.: 09/110,415

[22] Filed: Jul. 6, 1998

[30] Foreign Application Priority Data

Jul. 7, 1997 [JP] Japan ..... P09-181271

[51] Int. Cl.[6] ..... G03G 15/00

[52] U.S. Cl. ..... 399/66; 399/299; 399/314

[58] Field of Search ..... 399/66, 299, 303, 399/306, 311–314

[56] References Cited

U.S. PATENT DOCUMENTS

| | | | |
|---|---|---|---|
| 5,041,877 | 8/1991 | Matsumoto . | |
| 5,363,178 | 11/1994 | Matsumoto . | |
| 5,469,248 | 11/1995 | Fujiwaka et al. . | |
| 5,600,421 | 2/1997 | Takekoshi et al. | 399/66 |
| 5,602,633 | 2/1997 | Yoshida et al. | 399/244 |
| 5,740,493 | 4/1998 | Otaki et al. | 399/71 |
| 5,758,038 | 5/1998 | Itoh et al. | 399/99 X |
| 5,794,110 | 8/1998 | Kasai et al. | 399/299 |
| 5,797,070 | 8/1998 | Waki et al. | 399/149 |

FOREIGN PATENT DOCUMENTS 60-144765 6/1994 Japan .

*Primary Examiner*—Richard Moses
*Attorney, Agent, or Firm*—Foley & Lardner

[57] ABSTRACT

The image forming apparatus has a first through a fourth image forming stations which form images in respective colors. Under theses image forming stations, there is provided the transfer belt to convey a paper. Inside the transfer belt, transfer rollers are arranged to apply prescribed transfer bias voltage to the image carriers of the image forming stations. When, for instance, a monochromatic image is formed at the fourth image forming station, 500V transfer bias voltage is applied to the transfer rollers of the first through third image forming stations and 1,00V transfer bias voltage is applied to the transfer roller of the fourth image forming station. Thus, it is possible to prevent undesirable charge-up to the paper and form monochromatic image of good quality.

18 Claims, 5 Drawing Sheets

IMAGE FORMING APPARATUS

BACKGROUND OF THE INVENTION

1. Field of the Invention

The present invention relates to an image forming apparatus which forms a color image on a recording paper by multi-transferring toner images in respective colors on the recording paper based on color separated image signals.

2. Description of the Related Art

As an apparatus to form a color image on a recording paper by multi-transferring toner images in respective colors on the recording paper one over another, for instance, a quadruple tandem system copying machine is so far known. This type of copying machine has four image forming stations each of which forms a yellow, magenta, cyan or black color toner image, respectively.

In each of these image forming stations, an electrostatic latent image is formed on photosensitive bodies charged to prescribed potential based on color separated image signals and a toner image in respective color is developed and formed on the photosensitive bodies by supplying charged respective color toners to the electrostatic latent image.

Under the image forming stations, there is arranged a transfer belt which runs endlessly in contact with the photosensitive bodies of the stations. At the location in the inside of the transfer belt, opposite to the respective photosensitive bodies, transfer rollers are arranged. These transfer rollers are applied with transfer bias voltage to have electrostatic force act on toner images on the photosensitive bodies.

When a color image is formed using such the copying machine, a recording paper is conveyed between the image forming stations and the photosensitive bodies by holding it on the transfer belt. Toner images in respective colors are formed on the photosensitive bodies and prescribed transfer bias voltage is applied to each of the transfer rollers. When this transfer bias voltage is applied, an electrostatic force acts on the toner images formed on respective photosensitive bodies toward the transfer belt. By this electrostatic force, respective color toner images are multi-transferred on a recording paper. The color toner images multi-transferred on the recording paper are heated, pressed and fixed on the recording paper in the fixing device. Thus, when a toner image is fixed on the recording paper, a color image is formed on this recording paper.

In this type of copying machine, when transferring toner images in respective colors formed on respective photosensitive bodies on a recording paper, prescribed transfer bias voltage is applied to each of the transfer rollers. At this time, a relatively large electric field is formed by the white ground potential on the photosensitive bodies and the potential of the transfer rollers. Between a recording paper being conveyed between the photosensitive bodies and the transfer rollers and the photosensitive bodies, the discharge is produced by this large electric field and the recording paper is charged up by electric charge of polarity reverse to the polarity of the transfer bias voltage. Therefore, in the transfer process from the first station (yellow) to the fourth station (black), the transfer electric field is gradually reduced by the charge resulting from the charge-up of a recording paper. By this reduction of the transfer electric field, the faulty transfer of a toner image on a recording paper may be produced particularly in the fourth station.

Therefore, on a conventional copying machine it was so set that the transfer bias voltage was gradually increased toward the fourth station from the first station to prevent such the faulty transfer. However, depending on change in environmental conditions (temperature and humidity) and difference in type of recording paper, there is no margin of the transfer bias voltage particularly in the fourth station. Accordingly, the faulty transfer was produced under the environment of low temperature and low humidity and transfer pits were produced by excessive toner image transfer under the environment of high temperature and high humidity.

When outputting a monochromatic color image using the quadruple tandem system copying machine, the same transfer bias voltage as that when outputting the color image described above is also applied to the transfer rollers of respective stations.

Because of this, when particularly outputting only a black image of the fourth station, a recording paper was charged up likewise the above, causing the faulty transfer or producing transfer pits.

SUMMARY OF THE INVENTION

It is an object of the present invention to provide an image forming apparatus that is capable of forming a monochromatic color image of good quality on a recording paper using an image forming apparatus that forms a color image on a recording paper by multi-transferring toner images in respective colors on the recording paper.

According to the present invention, an image forming apparatus is provided. This image forming apparatus is composed of first image forming means for forming a first developer image on a first image carrier; second image forming means for forming a second developer image on a second image carrier; conveying means for conveying an image receiving medium toward the first and second image carriers; first transferring means provided opposite to the first image carrier for transferring the first developer image on the image receiving medium conveyed by the conveying means; second transferring means provided opposite to the second image carrier for transferring the second developer image on the image receiving medium conveyed by the conveying means; first bias voltage applying means for applying transfer bias voltage to the first transferring means; second bias voltage applying means for applying transfer bias voltage to the second transferring means; and control means for controlling first bias voltage applying means to supply the first transfer means with a first voltage and for controlling second bias voltage applying means to supply the second transfer means with a second voltage that is smaller than the first voltage when a developer image is formed only on the first image carrier.

DETAILED DESCRIPTION OF THE PREFERRED EMBODIMENTS

Hereinafter, embodiments of the present invention will be described in detail referring to the attached drawings.

Figure 1:
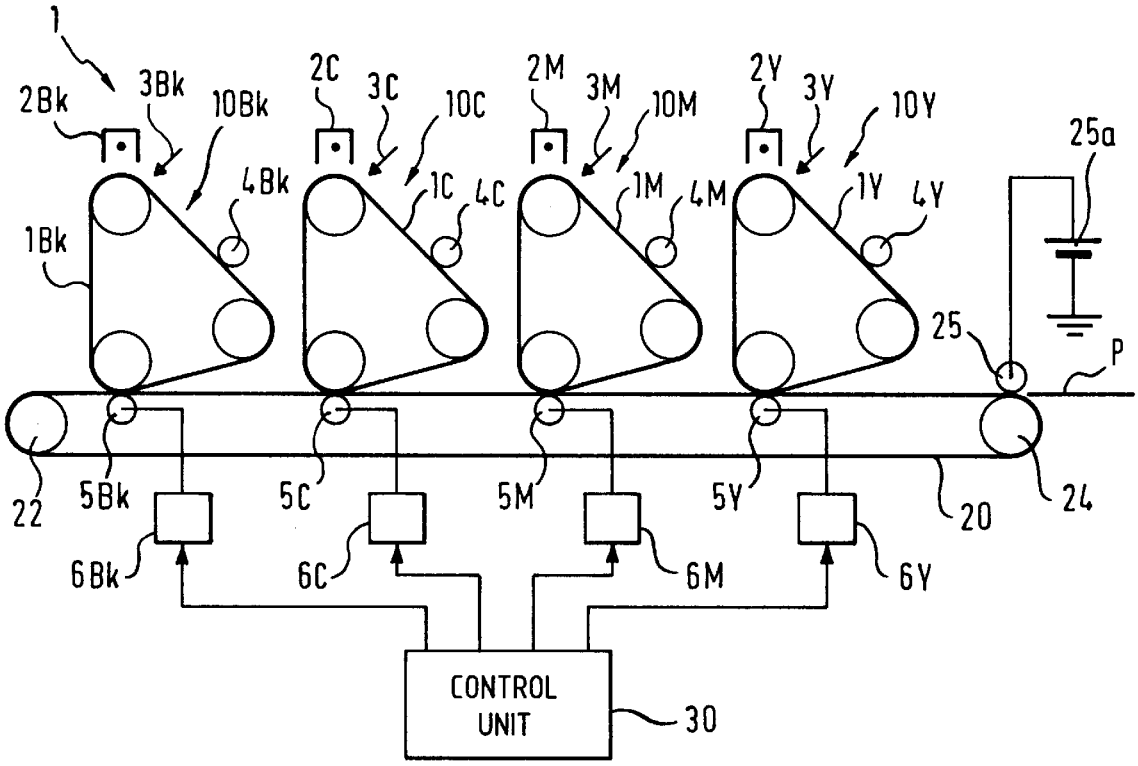
FIG. 1 is a schematic diagram illustrating the first embodiment of the image forming apparatus of the present invention.

FIG. 1 illustrates an image forming apparatus of a first embodiment of the present invention, for instance, a quadruple tandem system full color copying machine 1 (hereinafter, simply referred to as a copying machine 1). This copying machine 1 is equipped with a first through fourth electro-photographic system image forming stations 10Y, 10M, 10C and 10Bk (the image forming means) which form 4 color images of yellow (Y), magenta (M), cyan (C) and black (Bk), respectively. Four color images in yellow (Y), magenta (M), cyan (C) and black (Bk) are formed based on color separated image data. These image forming stations (hereinafter, simply referred to as stations) 10Y, 10M, 10C and 10Bk are provided in parallel with each other at a specified interval in the about horizontal direction.

Below the stations 10Y, 10M, 10C and 10Bk, there is a transfer belt 20 (a feeding means) provided to convey a recording paper P that is an image receiving medium throughout respective stations. This transfer belt is stretched over a driving roller 22 and a following roller 24, which are arranged separately each other. This transfer belt 20 is driven endlessly in the direction from the first station 10Y to the fourth station 10Bk. The following roller 24 is pressed by a spring, etc. (not shown) in the direction leaving from the driving roller 22 and thus, a specified tension is given to the transfer belt 20 that is stretched over both rollers.

Above the following roller 24 around which the transfer belt 20 is stretched, an absorbing roller 25 is provided in contact with the transfer belt 20. An adsorbing bias power source 25*a* is connected to the adsorbing roller 25 and prescribed bias voltage is supplied between the earthed following roller 24. Thus, when adsorbing bias voltage is supplied, a recording paper P passing between the adsorbing roller 25 and the transfer belt 20 is adsorbed to the transfer belt 20 electrostatically.

The first through fourth stations 10Y, 10M, 10C and 10Bk are nearly in the same structure and so, the first station 10Y provided at the upper stream side in the conveying direction of a paper P to form a yellow image will be described here as a representative example. The same component elements of other stations as those of the first station 10Y are assigned with the same reference numerals suffixed with magenta (M), cyan (C) and black (Bk) and their explanations will be omitted.

The first station 10Y has a photosensitive belt 1Y that acts as an image carrier. This photosensitive belt 1Y is stretched around three rollers and runs endlessly in the same direction as the transfer belt 20 at the same speed. The roller out of three rollers located at the lowest position with the photosensitive belt 1Y wound round it acts to keep the photosensitive belt 1Y in contact with the transfer belt 20.

Around the photosensitive belt 1Y, there are a main charger 2Y, an exposure unit (not shown), a developing device 4Y and a transfer charger 5Y (a transfer member) provided in order. The main charger 2Y charges the surface of the photosensitive belt 1Y at a prescribed potential. The exposure unit exposes the charged surface of the photosensitive belt 1Y by laser beam 3Y based on the separated color image signal and forms an electrostatic latent image. The developing device 4Y develops this electrostatic latent image by supplying a charged toner (a developer) to the image by the action of the developing bias voltage applied to this device. The transfer roller 5Y transfers this developed toner image (a developer image) on a recording paper P conveyed while being adsorbed by the transfer belt 20. The transfer roller 5Y is arranged in the inside of the transfer belt 20 at the location opposite to the lowest roller with the photosensitive belt 1Y wound round thereto.

The transfer rollers 5Y, 5M, 5C and 5Bk are connected with bias voltage sources 6Y, 6M, 6C and 6Bk, respectively, which apply transfer bias voltage. Each bias voltage source is controlled by a control unit 30 (a control means) so as to vary transfer voltage applied to the transfer rollers.

Now, the operation to form a yellow image in the first station 10Y will be described below. First, the surface of the photosensitive belt 1Y is charged to about −400V to −800V by the main charger 2Y. The photosensitive belt 1Y was formed by a photosensitive layer laminated on a conductive base material. This photosensitive layer is normally highly resistive but has such a character that relative resistance of the portion applied with laser beam will change when the laser beam 3Y is applied. The laser beam 3Y is output to the surface of the charged photosensitive belt 1Y via the exposure unit (not shown) based on image data for yellow color furnished from the control unit (not shown). The laser beam 3Y is applied to the photosensitive layer on the surface of the photosensitive belt 1Y and an electrostatic latent image in a yellow printing pattern is formed on the surface of the photosensitive belt 1Y.

When the laser beam 3Y is applied to the surface of the photosensitive belt 1Y of which entire surface was charged uniformly, the relative resistance of the laser beam applied portion of the photosensitive layer drops and the charge on the surface of the photosensitive belt 1Y flows to the conductive base material of the photosensitive belt. On the other hand, the charge of that portion not applied with the laser beam 3Y remains. Thus, an electrostatic latent image is composed of a portion less electric charge that flowed to the conductive base material of the photosensitive belt and a portion with electric charge left. This electrostatic latent image is a so-called negative latent image.

The electrostatic latent image thus formed on the photosensitive belt 1Y is rotated to a prescribed developing position following the travel of the photosensitive belt 1Y. Then, at this developing position, the electrostatic latent image formed on the photosensitive belt 1Y is developed to a visible image (a toner image) by the developing device 4Y applied with the developing bias voltage.

In the developing device 4Y, a yellow toner formed with resin containing yellow dye is housed. This yellow toner is friction charged to the same polarity (the negative polarity) as that of electric charge on the photosensitive belt 1Y when it is stirred in the developing device 4. When the surface of the photosensitive belt 1Y passes through the developing device 4Y, the yellow toner adheres to the charge eliminated latent image portion only on the surface of the photosensitive belt 1Y electrostatically and this latent image is developed by the yellow toner. The photosensitive belt 1Y with the yellow toner image formed is traveled in succession at a prescribed speed and the toner image developed on the photosensitive belt 1Y is conveyed to a prescribed transfer position.

On the other hand, a recording paper P supplied between the adsorbing roller 25 and the transfer belt 20 via a paper supply mechanism (not shown) is adsorbed on the transfer belt 20 by the adsorbing bias voltage applied via the adsorbing roller 25. Then, the paper P is conveyed through all stations while being kept adsorbed on the transfer belt 20. That is, the recording paper P conveyed by the transfer belt 20 passes through a plurality of the transfer positions in order where the transfer rollers 5Y, 5M, 5C and 5Bk of the stations are provided.

When the yellow toner image on the photosensitive belt 1Y is conveyed to the transfer position, the recording paper P is conveyed to the transfer position as described above. A prescribed transfer bias voltage is applied to the transfer roller 5Y and an electrostatic force moving from the photosensitive belt 1Y toward the transfer roller 5Y acts on a toner image. By this action of the electrostatic force, the toner image on the photosensitive belt 1Y is transferred on the recording paper P. The transfer bias voltage applied at this time has the (+) polarity that is reverse to the toner's polarity (−) and for instance, in the first station 10Y it is set at about +1,000V by the control unit 30.

Further, transfer bias voltages applied to the transfer rollers 5M, 5C and 5Bk subsequent to the second station 10M are so set that they become higher at latter stages. This is because the transfer electric field will become more weak at latter stages. That is, when a recording paper P passes the transfer position of each station, the toner on the recording paper P is subject to the charge of (−) polarity by the discharge taken place between the photosensitive belt. This is because the transfer electric field is made weak gradually with the accumulation of this charge on the toner on the recording paper P. In this embodiment, the transfer bias voltages for colors subsequent to magenta were set at +1,080V, +1,200V and +1,350V under the environmental conditions of 20° C. and 50% RH, respectively. Further, proper values of these transfer bias voltages are changed properly based on kind of recording paper P, environmental conditions, kind of toner, resistance of the transfer belt 20, resistance of the transfer roller, etc.

After the toner image on the recording paper P was transferred, the photosensitive belt 1Y is traveled at the prescribed speed and residual toners and paper powder on the photosensitive belt 1Y are cleaned by a cleaner (not shown). Thereafter, a series of processes from the main charger 2 starts when required.

Thus, the recording paper P carrying the yellow toner image transferred in the first station 10Y is conveyed successively to the second to the fourth stations 10M, 10C and 10Bk by the transfer belt 20 and respective color toner images are transferred (multi-transferred) one over another in the similar manner as above.

The recording paper P with toner images multi-transferred in all colors through the first to the fourth stations is conveyed into a fixing device (not shown). The toner image just put on the recording paper P by the electric charge force is heated by this fixing device, the superposed color toner images are fused and fixed on the recording paper P. The recording paper P carrying the completely fixed color image is carried out to an exit portion and a series of the color image forming operation is completed.

By the way, the transfer belt 20 and the transfer rollers 5Y–5Bk described above are formed as shown below. The transfer belt 20 is made of a resin material such as polyimide, polycarbonate, fluoric resin, etc. with carbon, ion conductive material, etc. dispersed. These carbon, ion conductive materials dispersed in the resin material gave conductivity to the resin material and adjusted its resistance values to $10^{10}$ to $10^{14}\Omega\cdot$cm. If a resistance value is lower than this value, the electric field formed between the transfer roller and the photosensitive belt becomes unnecessarily strong and leak current will flow to the photosensitive belt via the transfer belt from the transfer roller. By this leak current, pinholes are produced on the photosensitive layer of the photosensitive belt. If a resistance value is higher than these values, a transfer electric field sufficiently strong enough for transferring toners cannot be formed and the faulty transfer is generated.

Further, the transfer rollers 5Y–5Bk are formed by elastic rollers made of foam urethane, etc. with carbon dispersed and its resistance value is adjusted to $10^4$ to $10^8\Omega\cdot$cm. If a resistance value is lower than this value, leak current flows to the photosensitive belt from the transfer roller via the transfer belt by the electric field formed by the applied transfer bias voltage and the surface potential of a photosensitive material. By this leak current, pinholes are produced on the transfer belt 20 or the photosensitive belt. Further, if a resistance value is too high, a transfer electric field sufficiently strong enough for transferring toners cannot be formed and the faulty transfer is generated.

In this embodiment, therefore, a 100 $\mu$m thick resin belt made of polyimide with carbon dispersed so that a resistance value will become about $10^{12}\Omega\cdot$cm was used as the transfer belt 20 and a conductive urethane sponge roller having a resistance value $5\times10^5\Omega\cdot$cm was used for the transfer rollers 5Y–5Bk.

Figure 2:
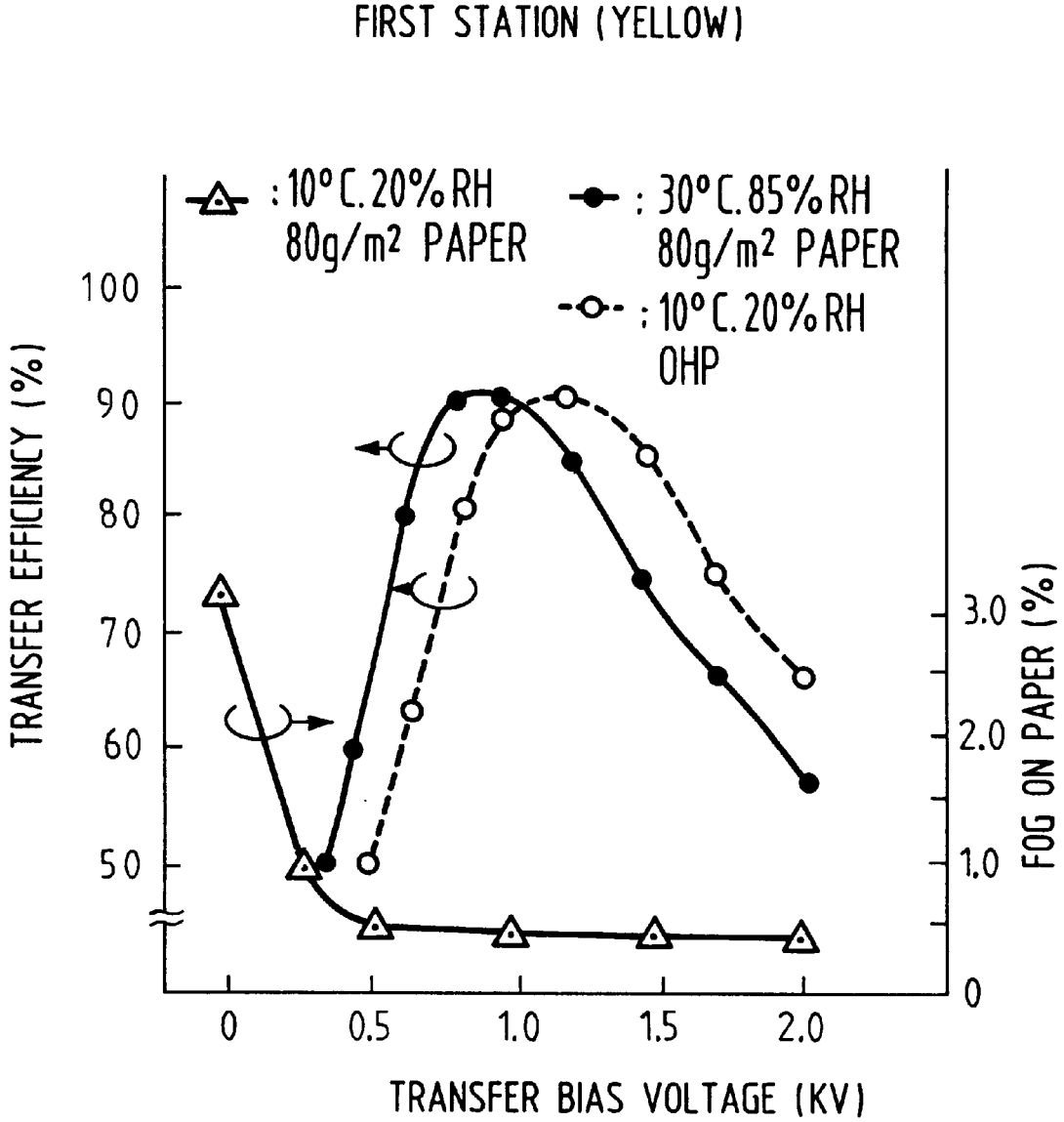
FIG. 2 is a graph illustrating transfer efficiencies and changes in fog on a recording paper when transfer bias voltage applied in the first station of the image forming apparatus illustrated in FIG. 1 was changed.

FIG. 2 illustrates percentages of fog produced on a recording paper P and changes in transfer efficiency of yellow toner when transfer bias voltage applied to the transfer roller 5Y of the first station 10Y was changed. Here, by changing transfer bias voltage by the control unit 30, transfer efficiency when a toner image was transferred on an OHP sheet under the low temperature and low humidity environment of 10° C., 20% RH, transfer efficiency when a toner image was transferred on a 80 g/m$^2$ under the high temperature and high humidity environment of 30° C., 85% RH and percentages of fog produced on paper when a toner image was transferred under the low temperature and low humidity environment of 10° C., 20% RH were investigated.

Further, the transfer efficiency $\eta$ referred to here was $\eta=100\times(D-Dr)/D$ (%), where D was an image density when a solid image on the photosensitive belt 1Y was measured by the taping before the transfer and Dr was an image density when the residual portion equivalent to the solid image on the photosensitive belt 1Y was measured by the taping after the transfer. Further, the fog percentages on recording paper were obtained by measuring differences between reflection factors of printed recording paper and unprinted recording paper using a Minoruta made CR-100 Color Difference Meter. The taping is a method to take a toner on the photosensitive belt on a 3M made Scotch Tape (the trademark), affix this Scotch Tape to a paper and measure a density by applying the light to the tape surface of the side without a toner adhered.

As illustrated in FIG. 2, it can be seen that when transfer bias voltage was set at about +1,000V, satisfactory values exceeding 80% are shown for both the transfer efficiency of toner transferred on an OHP sheet under the environment of low temperature and humidity and that of 80 g/m$^2$ paper under the environment of high temperature and high humidity. Further, regarding the fog on paper, while 3% fog was produced at a transfer bias voltage 0V, a satisfactory value below 1% was shown if transfer bias voltage more than +300V was applied and it is seen that an image of good quality can be formed. Accordingly, it is seen that it is better to set transfer bias voltage at the first station 10Y at about +1,000V.

Figure 3:
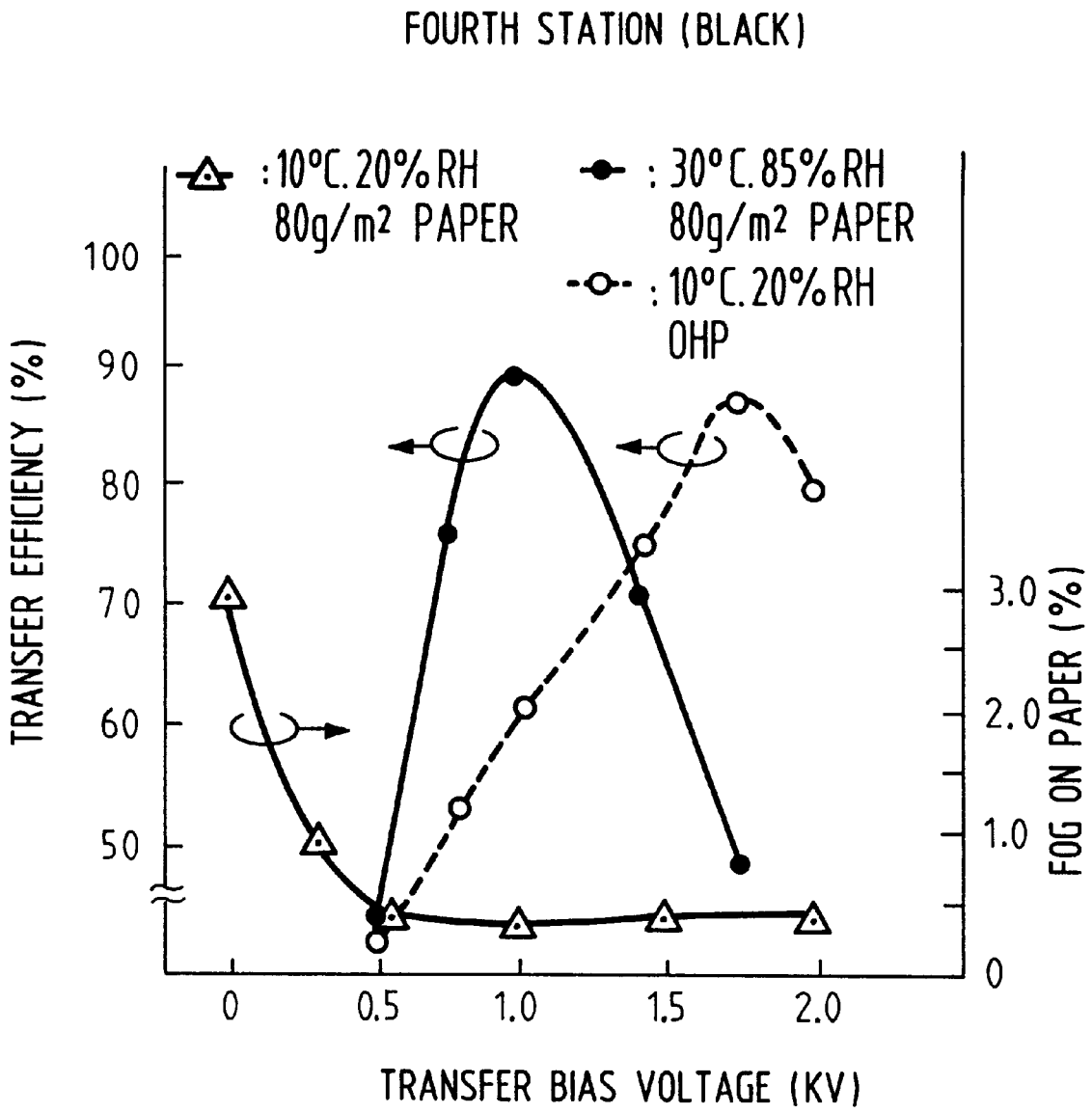
FIG. 3 is a graph illustrating transfer efficiencies and changes in fog on a recording paper when transfer bias voltage applied in the fourth station of the image forming apparatus illustrated in FIG. 1 was changed.

On the other hand, FIG. 3 illustrates percentages of the fog on paper and changes in transfer efficiency when the transfer bias voltage applied to the transfer roller 5Bk of the fourth station was changed. Here, similar to the first station 10Y, the transfer efficiency when a toner image was transferred on an OHP sheet under the environment of low temperature and low humidity of 10° C., 20% RH, the transfer efficiency when a toner image was transferred on a 80 g/m$^2$ paper under the environment of high temperature and high humidity of 30° C., 85 RH and percentages of fog on a paper when a toner image was transferred on a 80 g/m$^2$ paper under the environment of low temperature and low humidity of 10° C., 20RH were investigated.

As illustrated in FIG. 3, it is seen that there was no transfer bias voltage that provides a satisfactory transfer efficiency of more than 80% on both an OHP sheet under the environment of low temperature and low humidity and a 80 g/m$^2$ paper under the environment of high temperature and high humidity. That is, when the transfer bias voltage in the fourth station 10Bk was set at +1,350V as described above, the faulty transfer due to the insufficient transfer is produced on an OHP sheet and a thick paper under the environment of low temperature and low humidity. Further, under the environment of high temperature and high humidity, transfer pits due to excessive transfer will produced on a 80 g/m$^2$ paper. On the other hand, regarding the fog on paper, similar to the transfer at the first station 10Y, while 3% fog was produced at 0V transfer bias voltage, a satisfactory value less than 1% was shown if transfer bias voltage more than +300V was applied and it is seen that an image of good quality can be formed. Accordingly, it is seen that the faulty transfer and transfer pits may be produced depending on environmental temperature and humidity.

Figure 4:
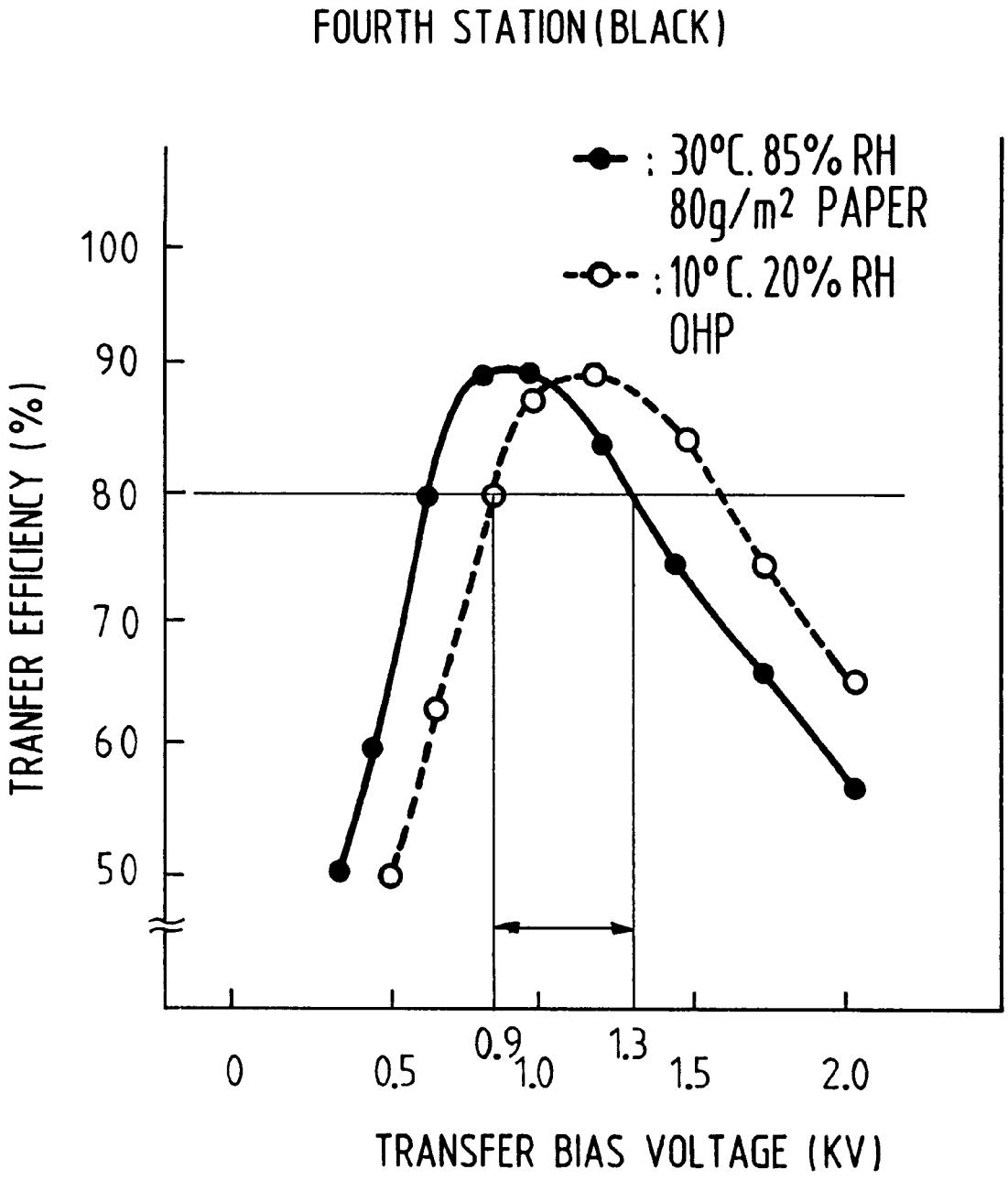
FIG. 4 is a graph illustrating transfer efficiencies for transfer bias voltage when a monochromatic color image was formed in the fourth station of the image forming apparatus illustrated in FIG. 1.

FIG. 4 illustrates percentages of the fog produced on a paper and changes in the transfer efficiency when transfer bias voltages in the first through the third stations 10Y, 10M and 10C were set at +500V and transfer bias voltage applied to the transfer roller 5Bk was changed in the fourth station 10Bk to output a monochromatic image in the fourth station. Here, the transfer bias voltage applied to the transfer roller 5Bk was changed by the control unit 30 and the transfer efficiency when a toner image was transferred on an OHP sheet under the low temperature and low humidity environment of 10° C., 20% RH and the transfer efficiency when a toner image was transferred on a 80 g/m$^2$ paper under the environment of high temperature and high humidity of 30° C., 85% RH were investigated. Further, the transfer bias voltage applied in the first through the third stations was made at a value producing no fog on a paper (not 0V).

According to this investigation, when the transfer bias voltage applied in the first through the third stations was set at a low level, the charge-up of a recording paper P due to the effect of the strong transfer electric field in the first through the third stations was eliminated. So, it is seen that a satisfactory transfer efficiency more than 80% was obtained in a relatively wide range of +900V to +1,300V on both an OHP paper under the low temperature and low humidity environment and a 80 g/m$^2$ under the high temperature and high humidity environment. Further, if the transfer bias voltage is increased to more than +600V in the first through the third stations wherein a toner image is not transferred, the charge-up began to be observed on a recording paper P and the margin of the transfer bias voltage in the fourth station 10Bk showing a satisfactory transfer efficiency more than 80% becomes narrow.

Therefore, when the transfer bias voltage in the fourth station 10Bk is set at, for instance, +1,000V and the transfer bias voltage in the first through the third stations 10Y, 10M and 10C are set in a range from +300V to +600V, wherein no fog is produced on paper, a monochromatic image of good quality, that is, a black image can be formed.

Further, also when a monochromatic image in black color only is forming, the belts 1Bk, 1C, 1M and 1Y are driven so that they move in the same direction as the belt 20 in order to convey a paper P smoothly. The first image forming station 10Y corresponding to yellow, the second image forming station 10M corresponding to magenta and the third image forming station 10C corresponding to cyan are operating as described below. That is, the main charger 2Y of the first image forming station 10Y, the main charger 2M of the second image forming station 10M and the main charger 2C of the third image forming station 10C uniformly charge the photosensitive belts 1Y, 1M and 1C in the same manner as in the full color image forming. However, as there is no data corresponding to color components of yellow, magenta and cyan, the laser beams 3Y, 3M and 3C of the exposure units are not applied to the photosensitive belts 1Y, 1M and 1C. In other words, an electrostatic latent image was not formed on each photosensitive belt. Although developing bias voltage was applied to the developing devices 4Y, 4M and 4C of respective stations, as an electrostatic latent image was not formed on the photosensitive belts 1Y, 1M and 1C, no toner image is formed. As described above, even when a monochromatic image in black color only is formed, other color image forming stations also operate similarly in the full color image formation. As the photosensitive belt, even when it does not form an image, is charged and developing bias voltage is applied to a developing device opposite to this photosensitive belt, the production of fog is prevented. Even when other color image forming stations 10Y, 10M and 10C are in operation, no laser beam is applied from the exposure unit and therefore, theoretically a toner does not adhere to the photosensitive belts 1Y, 1M and 1C but actually, positively reverse charged toner adheres to the photosensitive belts 1Y, 1M and 1C. In this embodiment, the transfer of this reverse charged toners to a paper P is prevented by applying transfer bias voltage in a prescribed size, and only black toner is transferred to a paper P.

Therefore, as it is not necessary to separate the developing devices of the image forming stations other than the image forming station, which forms a monochromatic image, from the photosensitive belts and to separate the transfer rollers from the photosensitive belts, it is not required to provide a separating mechanism.

Transfer efficiency when the monochromatic printing was made were investigated on the first through the third stations 10Y, 10M and 10C. As a result, although there is some difference depending on the transfer sequence, satisfactory transfer efficiency more than 80% could be obtained in each station when the transfer bias voltage applied to the printing station was set at +1,000V and the transfer bias voltage for other stations that do not make the printing was set in a range of +300V to +600V. In other words, it is seen that a monochromatic color image of good quality without faulty transfer and less fog generated on paper can be formed when the transfer bias voltage for a monochromatic color printing station was set at +1,000V and that for other stations which do not make the monochromatic color printing was set in a range of +300V to +600V.

The present invention is not limited to the embodiment described above but is applicable in various modified forms within its spirit and scope. For instance, when performing the monochromatic color printing using the copying machine 1 described above, proper transfer bias voltage in a station which performs the printing and transfer bias voltage in station which do not perform the printing vary based on resistance of the transfer rollers and transfer belts, toner state, etc. Further, although the transfer roller was used as a means to apply transfer bias voltage in the above first embodiment, other members such as a transfer brush are also usable. Furthermore, even when the present invention is applied to an apparatus described below, the same effects as in the first embodiment can be obtained. Further, although a case to form a black image in the fourth station was explained in the above embodiment, the present invention is also applicable not only to a case to form a monochromatic color image in the fourth station but also to a case to form an image only in any station of the first through the third stations. When an image is formed only in the first station, as a toner image is not formed before a paper arrives at the first station, there is no such a problem as a narrow transfer bias voltage that is caused when an image is formed only in the fourth station.

However, when a negative charged toner image was transferred on a paper in the first station, the paper was negative charged and there is another problem that the toner on a paper is apt to be returned to the photosensitive belt side by an electrostatic repulsive force.

As in the present invention, when a toner image is formed in the first station, the return of toner can be prevented by supplying lower transfer bias voltage than the first station to the second through the fourth station.

Figure 5:
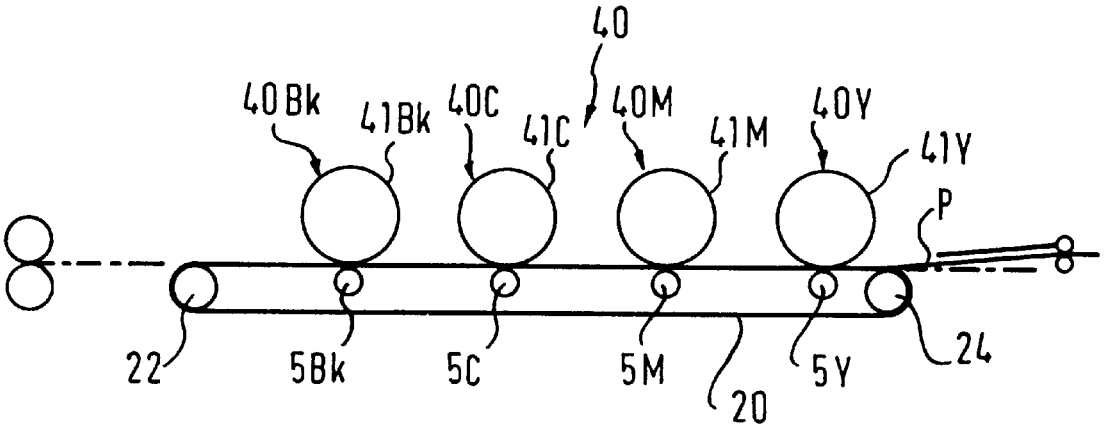
FIG. 5 is a schematic diagram illustrating the second embodiment of the image forming apparatus of the present invention.

FIG. 5 schematically illustrates a copying machine 40 involved in a second embodiment of the present invention. This copying machine 40 is equipped with photosensitive drums 41Y, 41M, 41C and 41Bk instead of the photosensitive belts 1Y, 1M, 1C and 1Bk. Other component elements of this copying machine are all the same as those of the copying machine 1 in the first embodiment described above. So, these component elements are assigned with the same reference numerals as those of the copying machine 1 and their explanations will be omitted. Further, the transfer rollers 5Y, 5M, 5C and 5Bk are connected with bias power sources 6Y, 6M, 6C and 6Bk, respectively, which are controlled by the control unit 30.

When a recording paper P is conveyed through the first to the fourth stations 40Y, 40M, 40C and 40Bk with the travel of the transfer belt 20 and applied with prescribed bias voltage, toner images in respective colors formed on the photosensitive drums 41Y, 41M, 41C and 41Bk are transferred one over another on the recording paper P.

To output a monochromatic color image using this copying machine 40, it is possible to form a monochromatic color image of good quality without faulty transfer and less fog generation on a paper similarly in the first embodiment described above when transfer bias voltage for a station that performs the monochromatic printing is set at +1,000V and transfer bias voltage for stations that do not perform the printing is set at +300V to +600V.

Figure 6:
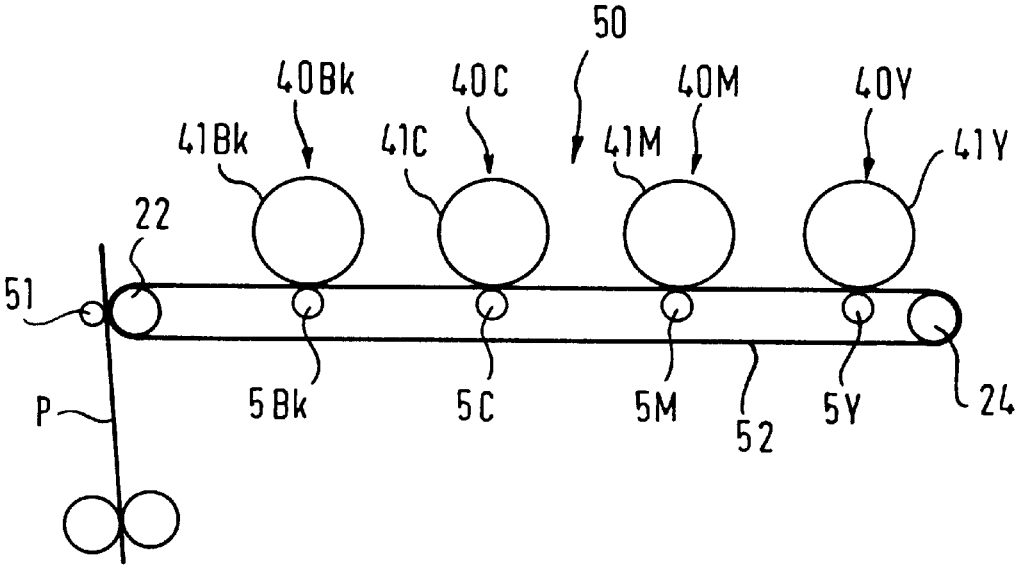
FIG. 6 is a schematic diagram illustrating the third embodiment of the image forming apparatus of the present invention.

In FIG. 6, a copying machine 50 involved in a third embodiment of the present invention is schematically illustrated. This copying machine 50 is provided with an intermediate transfer belt 52 instead of the transfer belt 20 and a transfer roller 51 at the outside of the driving roller 22 with the intermediate transfer belt 52 wound round it. All other component elements are the same as those of the copying machine 40 in the above second embodiment 2 and therefore, the same component elements are assigned with the same reference numerals and the explanations will be omitted. Further, bias power sources 6Y, 6M, 6C and 6Bk which are controlled by the control unit 30 are connected to the transfer rollers 5Y, 5M, 5C and 5Bk, respectively.

Then, when toner images in respective colors are formed on the photosensitive drums 41Y, 41M, 41C and 41Bk of the stations 40Y, 40M, 40C and 40Bk, prescribed transfer bias voltage is applied to the transfer rollers 5Y, 5M, 5C and 5Bk. When this transfer bias voltage is applied, the toner images in respective colors formed on the photosensitive drums 41Y, 41M, 41C and 41Bk are transferred one over another on the intermediate belt 52 that runs endlessly. Then, the color toner images multi-transferred on the intermediate transfer belt 52 are moved to the transfer position outside the driving roller 22, where the color images are transferred on a recording paper P conveyed between the transfer roller 51.

To output a monochromatic color image using this copying machine 50, a monochromatic color image of good quality without faulty transfer and less fog on a paper can be formed similarly in the first and second embodiments when transfer bias voltage is set at +1,000V for a monochromatic color printing station which performs the monochromatic color printing and at a range of +300V to +600 for stations which do not perform the monochromatic color printing.

As described above, the image forming apparatus of the present invention is in such structure and has actions as described above and is able to output monochromatic color images of good quality using the image forming apparatus that outputs color images by multi-transferring toner images in respective colors.

What is claimed is:

1. An image forming apparatus comprising:

first image forming means for forming a first developer image on a first image carrier;

second image forming means for forming a second developer image on a second image carrier;

conveying means for conveying an image receiving medium toward the first and second image carriers;

first transferring means provided opposite to the first image carrier for transferring the first developer image on the image receiving medium conveyed by the conveying means;

second transferring means provided opposite to the second image carrier for transferring the second developer image on the image receiving medium conveyed by the conveying means;

first bias voltage applying means for applying transfer bias voltage to the first transferring means;

second bias voltage applying means for applying transfer bias voltage to the second transferring means; and control means for controlling first bias voltage applying means to supply the first transfer means with a first voltage and for controlling second bias voltage applying means to supply the second transfer means with a second voltage that is smaller than the first voltage when a developer image is formed only on the first image carrier.

2. An image forming apparatus claimed in claim 1, wherein the first voltage is +700V to +1500V and the second voltage is +300V to +600V.

3. An image forming apparatus claimed in claim 1, wherein voltages differing from the first and second voltages are applied to the first and second transfer means when images are formed on both the first and second image carriers.

4. An image forming apparatus comprising:

a plurality of image forming means provided corresponding to a plurality of image carriers for forming images in respective colors on respective image carriers based on color separated image signals;

a plurality of image transfer means provided corresponding to the image carriers for transferring images formed by the image forming means on an image receiving medium; and bias voltage applying means for applying bias voltage to each of the transfer means;

selecting means for selecting one image carrier from among the plurality of the image carrier to form a monochromatic color image; and control means for controlling bias voltage applying means so as to supply first bias voltage to the transfer means corresponding to the selected image carrier and to supply second bias voltage to other transfer means which do not operate.

5. An image forming apparatus claimed in claim 4, wherein the second voltage is smaller than the first voltage but not zero (0).

6. An image forming apparatus claimed in claim 5, wherein the first voltage is in a range of +700V to +1,500V and the second voltage is in a range of +300V to +600V.

7. An image forming apparatus claimed in claim 4, wherein the image forming means includes:

first through fourth image carriers corresponding to yellow, magenta, cyan and black colors;

first through fourth electrostatic latent image forming means for forming electrostatic latent images on the first through fourth image carriers based on color separated image signals; and first through fourth developing means for developing electrostatic latent images formed on the first through fourth image carriers by the electrostatic latent image forming means with the developing bias voltage applied, respectively.

8. An image forming apparatus claimed in claim 7, wherein the first through fourth image carriers are photosensitive belts, respectively.

9. An image forming apparatus claimed in claim 7 further comprising:

a transfer belt for conveying the image receiving medium from the first image carrier through the fourth image carrier in order.

10. An image forming apparatus comprising:

a plurality of image forming means provided corresponding to a plurality of image carriers for forming images in respective colors on respective image carriers based on color separated image signals;

a plurality of image transfer means provided corresponding to the image carriers for transferring images formed by the image forming means on an image receiving medium; and bias voltage applying means for applying bias voltage to each of the transfer means;

first selecting means for selecting on mode from full color image forming mode and monochromatic color image forming mode;

second selecting means for selecting one image carrier from among the plurality of the image carrier when the monochromatic color image forming mode is selected;

first controlling means for controlling bias voltage applying means so as to supply first bias voltage to the transfer means corresponding to the selected image carrier and to supply second bias voltage to other transfer means which do not operate when the monochromatic color image forming mode is selected;

second controlling means for controlling bias voltage applying means so as to supply all the transfer means with third bias voltage when the full color image forming mode is selected.

11. An image forming apparatus claimed in claim 10, wherein the third voltage is smaller than the second voltage but not zero (0).

12. An image forming apparatus claimed in claim 11, wherein the first voltage increases gradually; +700V to 2,000V, the second voltage is +700V to 1,500V and the third voltage is +300 to +600V.

13. An image forming apparatus claimed in claim 10, wherein the image forming means includes:

first through fourth image carriers corresponding to yellow, magenta, cyan and block colors;

first through fourth electrostatic latent image forming means for forming electrostatic latent imaged on the first through fourth image carriers based on color separated image signals; and first through fourth developing means for developing electrostatic latent images formed on the first through fourth image carriers by the electrostatic latent image forming means with the developing bias voltage applied, respectively.

14. An image forming apparatus claimed in claim 13, wherein the first through fourth image carriers are photosensitive belts, respectively.

15. An image forming apparatus claimed in claim 13 further comprising:

a transfer belt for conveying the image receiving medium from the first image carrier through the fourth image carrier in order.

16. An image forming apparatus comprising:

image forming means provided in parallel with first through fourth photosensitive drums for forming electrostatic latent images on the first through fourth photosensitive drums, respectively based on color separated image signals and developing the electrostatic latent image in each color on respective first through fourth photosensitive drums by supplying charged developers in respective colors;

an intermediate transfer belt arranged in contact with the first through fourth photosensitive drums and is traveled from the first photosensitive drum toward the fourth photosensitive drums;

four transfer members arranged at the opposite side of the intermediate transfer belt corresponding to the first through fourth photosensitive drums;

bias voltage applying means for applying prescribed voltage to the four transfer members so as to transfer color developer images on the intermediate transfer belt one over another by forming an electric field ranging from the color developer images formed on the first through fourth photosensitive drums by the image forming means to the intermediate transfer belt;

developer image transfer means for transferring multi-transferred color developer images on the intermediate transfer belt by four transfer members applied with bias voltage by the bias voltage applying means on an image receiving medium; and control means for controlling voltage of the bias voltage applying means applied corresponding to a monochromatic color image so as to make voltage applied from the bias voltage applying means corresponding to a monochromatic color image as a first voltage when forming a monochromatic image on the image receiving medium and voltage from the other bias voltage applying means that does not form a monochromatic color image as a second voltage.

17. An image forming apparatus claimed in claim 16, wherein the second voltage is smaller than the first voltage and is not zero (0).

18. An image forming apparatus claimed in claim 17, wherein the first voltage is +700V to 1,500V and the second voltage is +300V to +600V.

* * * * *